US007713001B1

(12) United States Patent
Harlow et al.

(10) Patent No.: US 7,713,001 B1
(45) Date of Patent: May 11, 2010

(54) PIPE EXTRACTOR APPARATUS AND METHOD OF EXTRACTING PIPE

(76) Inventors: Joseph J. Harlow, N. 9371 Bon-I-Quay La., Germfask, MI (US) 49836; Michael M. Bauman, P.O. Box 148, Niton Junction, Alberta (CA) TOEISO ( * ) Notice: Subject to any disclaimer, the term of this patent is extended or adjusted under 35 U.S.C. 154(b) by 0 days.

(21) Appl. No.: 12/253,913

(22) Filed: Oct. 17, 2008

(51) Int. Cl.
*E02F 5/10* (2006.01)

(52) U.S. Cl. ..... 405/174; 405/154.1; 405/180; 171/45

(58) Field of Classification Search ..... 405/154.1, 405/174, 180, 181, 184.4, 183, 184; 37/142.5; 171/45, 46, 143
See application file for complete search history.

(56) References Cited

U.S. PATENT DOCUMENTS 2,386,615 A * 10/1945 Knapp ..... 37/466
5,190,409 A * 3/1993 Hall ..... 405/154.1
5,741,088 A * 4/1998 Kleyman ..... 405/181

* cited by examiner

*Primary Examiner*—David J Bagnell
*Assistant Examiner*—Benjamin Fiorello
(74) *Attorney, Agent, or Firm*—Robert L. Farris; Farris Law, P.C.

(57) ABSTRACT

The pipe extractor includes a main frame supported by wheels mounted on the main frame. The wheels are vertically movable, relative to the main frame, by a hydraulic cylinder. An extractor frame is pivotally attached to the main frame for pivotal movement about an extractor axis. A shank has an upper end attached to the extractor frame. A shoe with a pipe through passage is connected to a lower end of the shank. A self leveling linkage pivots the extractor frame about the extractor axis in response vertical movement of the wheels. A hitch beam is pivotally attached to the main frame. Pipe contacts the pipe through passage in the shoe and steers the main frame. A lister is mounted on the hitch beam. A ramp assembly and rear plow are pivotally connected to the shoe.

12 Claims, 6 Drawing Sheets

PIPE EXTRACTOR APPARATUS AND METHOD OF EXTRACTING PIPE

TECHNICAL FIELD

This invention relates generally to apparatus and methods for extracting pipe from beneath a ground surface and to a method of extracting underground pipe.

BACKGROUND OF THE INVENTION

Water, gasoline and oil as well as other fluids are commonly routed through pipe that is buried beneath a ground surface. Thousands of miles of pipe are generally required to reach selected destinations. Over time, the pipe may become obsolete, or placed out of commission for some reason. As a result, it is desirable, and in some states mandatory, that the unused pipe be extracted from beneath the ground surface. The recovered pipe is generally valuable, and may be suitable for reuse, recycled, or used in some other capacity, such as a structural member in construction.

The pipe is presently recovered by digging along the pipe line, and thereafter, in a separate operation, removing the pipe. Commonly, a backhoe is used to dig a trench, and another backhoe may follow with an implement having jaws for removing the pipe. In addition, a separate bulldozer is typically used to backfill the trench that was dug to remove the pipe. The present practice for removing pipe is extremely time consuming and laborious, and typically allows one mile of pipe or less to be extracted per day. Additionally, the present process typically creates a wide area of disturbed soil on both sides of the trench, thereby requiring extended amounts of time, effort and labor to backfill the trench. When the pipe line that is being removed is under a farm filed, a substantial area of valuable crop may be damaged during removal of a pipe line employing a conventional tractor backhoe or and excavator. Contamination of the top soil by subsoil may reduce crop production for several years.

SUMMARY OF THE INVENTION

The pipe extractor, for extracting pipe line from the ground includes a main frame with a left side beam and a right side beam. The left and right side beams are parallel to and laterally spaced from each other. A transverse beam is fixed to the left side beam and the right side beam adjacent to a rear end of the main beam. A left wheel arm with a left arm rear portion and a right wheel arm with a right arm rear portion are provided. An axle is attached to the left arm rear portion, the right arm rear arm portion and the rear end of the main frame. The axle pivotally supports the left wheel arm outboard of the main frame left side beam. The axle pivotally supports the right wheel arm outboard of the main frame right side beam. A left tire and wheel is journaled on a forward end of the left wheel arm. A right tire and wheel is jounaled on a forward end of the right wheel arm. A cross beam is fixed to the left wheel arm and the right wheel arm and spaced from the axle. At least one hydraulic cylinder is connected to the main frame and to the left wheel arm and the right wheel arm and is operable to move the main frame vertically.

An extractor assembly includes and extractor frame that is pivotally attached to the main frame for pivotal movement about an extractor pivot axis. A pair of spaced apart shanks have upper shank ends attached to the extractor frame. An extractor shoe with a U-shaped lower wall has a shoe left edge integral with a lower end of one of the pair of spaced apart shanks. A shoe right edge is integral with a lower end of the other one of the pair of spaced apart shanks. The pair of shanks and the extractor shoe provide a through pipe passage.

A ramp assembly is pivotally attached to the extractor shoe and extends rearwardly and upwardly from a trailing edge of the extractor shoe. The ramp assembly includes a pair of elongated spaced apart ramp bars that lift pipe passing through the pipe passage upwardly out of the ground.

At least one self leveling linkage assembly includes a drive link pivotally attached to the left wheel arm and the right wheel arm. A driven link is pivotally attached to the main frame. The driven link has a rear end pivotally attached to the drive link. A connector link is pivotally attached to a driven link front end and pivotally attached to the extractor frame. The self leveling linkage assembly is operable to pivot the extractor frame about the extractor pivot axis in response to pivotal movement of the left wheel arm and the right wheel arm relative to the main frame.

A hitch beam, for towing the main frame has a rear end pivotally attached to the main frame by a hitch pin for pivotal movement about a generally vertical axis. A hitch assembly is mounted on a front hitch beam end.

A lock member is mounted on the main frame. The lock member is movable between a released position, in which the main frame is free to pivot about the hitch pin relative to the hitch beam, and an engaged position. In the engaged position, the lock member blocks the main frame from pivotal movement relative to the hitch beam. The extractor shoe cooperates with pipe being extracted to pivot the main frame about the hitch pin relative to the hitch beam when the lock member is in a release position.

A front earth working tool is attached to the hitch beam forward of the main frame. The earth working tool is a lister.

A deflector plate is secured between the pair of space apart shanks above the through pipe passage. The deflector plate extends rearwardly and upwardly from a horizontal leading edge and lifts soil upward as the soil passes between the space apart shanks.

BRIEF DESCRIPTION OF THE DRAWINGS

Some of the objects, features and advantages will be apparent in view of the following detailed description of the presently preferred embodiments and best mode, appended claims, and accompanying drawings, in which:

DETAILED DESCRIPTION OF THE PREFERRED EMBODIMENTS

Figure 3:
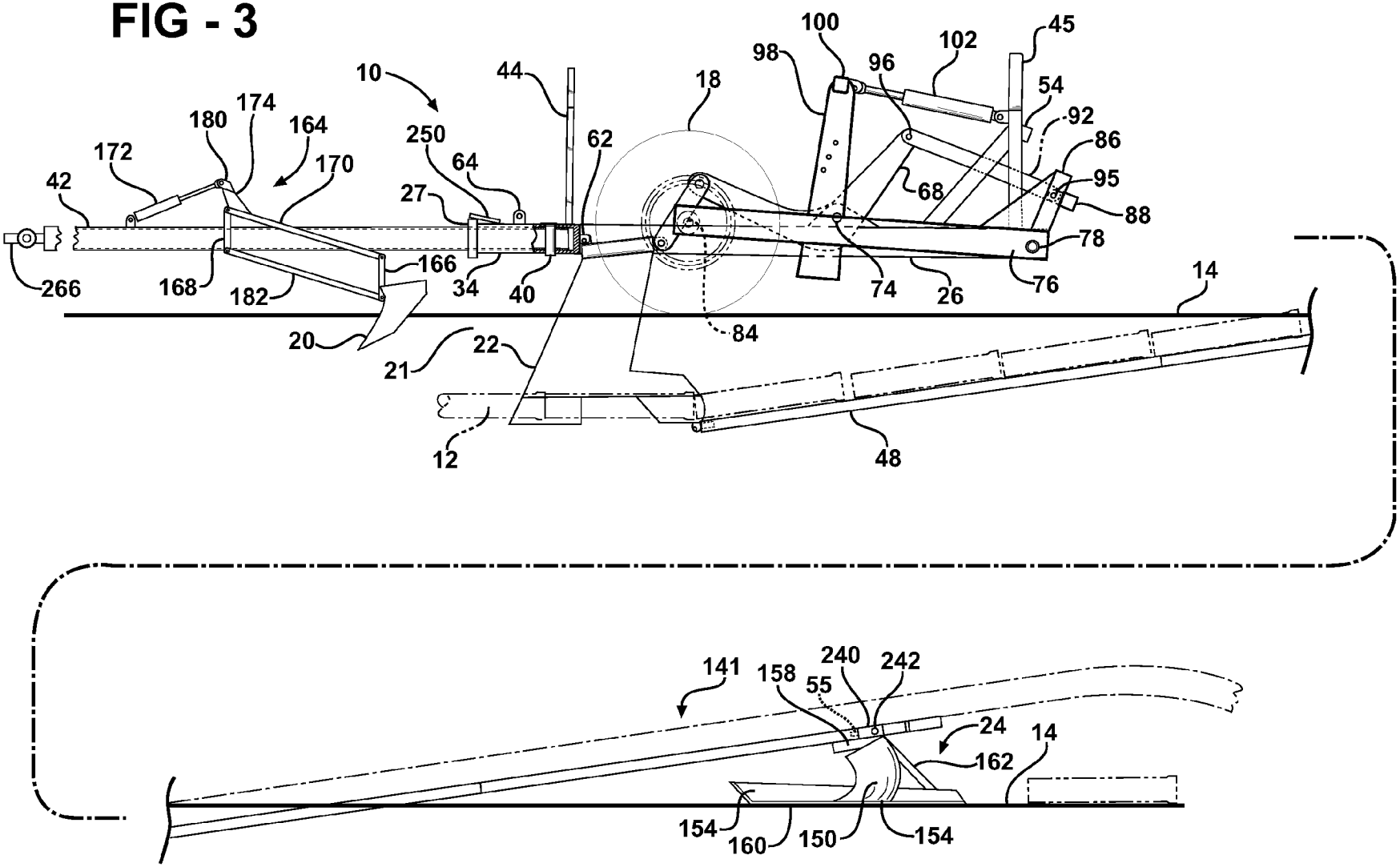
FIG. 3 is a reduced left side elevational view with parts broken away and the pipe extractor in operation.

Referring now in more detail to the drawings, FIG. 3 illustrates an apparatus 10 for extracting a generally continuous line of pipe 12 that has been buried beneath a ground surface 14. The apparatus 10 is generally constructed for attachment to a motorized vehicle, such as a tractor (not shown) for example, allowing the apparatus 10 to be pulled along the line of pipe to extract the pipe 12 from beneath the ground surface 14. The apparatus 10 has a pair of support members, represented here as tires 18, arranged for relative movement and engagement with the ground 14. A front plow 20, represented here as a lister plow is operable to plow a trench 21 to a predetermined depth to facilitate removing the pipe 12 from beneath the ground. The front plow removes grasses, roots and other plant material above pipe line, that could hinder pipe extraction. An extractor 22 is carried by the apparatus 10 rearward of the front plow 20 and is arranged for movement to a depth below the depth plowed by the front plow 20 to position the extractor 22 at least in part beneath the pipe to facilitate extracting the pipe 12 from beneath the ground surface 14. As the pipe is removed from beneath the ground surface 14, it trails behind the extractor 22 and is preferably routed over a rear plow 24. The rear plow 24 is preferably pulled behind the extractor 22 for movement along the ground surface 14 to backfill the trench 21 plowed by the front plow 20. Accordingly, the apparatus 10 is able to partially uncover the pipe 12 by plowing trench 21, extract the pipe from beneath the ground surface 14, and backfill the trench 21 from which the pipe was removed in a continuous process. As such, the apparatus 10 eliminates the need for multiple pieces of machinery, reduces the manpower required to unearth pipe, and greatly increases the amount of pipe that can be unearthed per day by upwards to ten-fold, or more.

The apparatus 10 has a main frame 26 constructed of rigid, durable material, such as tubular steel, by way of example and without limitation. The main frame 26 has a front end 27 and a rear end 28 with a pair of laterally spaced sides 29, 30 extending there between. Preferably, a pair of plates, referred to hereafter as an upper plate 32 and a lower plate 34, extend between the sides 29, 30 generally adjacent the front end 27 to define a housing 36. The upper and lower plates 32, 34 have through openings 38 in vertical axial alignment with one another and located generally centrally between the sides 29, and rearward of the front end 27. The through openings 38 are sized for receipt of a hitch pin 40 to provide releasable and pivotal attachment of a hitch beam 42 to the main frame 26.

The main frame 26 preferably has a pair of upstanding supports 44, 45 extending upwardly from the sides 29, 30. One of the supports 44 is located generally proximate the front end 27, and is shown in drawing FIG. 2 positioned rearwardly from the upper and lower plates 32, 34, while the other support 45 is located generally adjacent the rear end 28. Each of the supports 44, 45 has a laterally extending beam 46, 47, respectively, to provide a shelf for stowing components of the apparatus, such as the hitch beam 42 and a plurality of the ramp sections 48. To facilitate stowing the ramp sections 48 and the hitch beam 42, each of the supports 44, 45 preferably has a pair of upstanding restraint rods 50, shown in FIGS. 1 & 2, spaced laterally from one another to retain the ramp sections and the hitch beam on the laterally extending beams 46 and 47. It should be recognized that the supports 44, 45 are preferably spaced a predetermined distance from one another so that guide beams 48 and the hitch beam 42 span the distance between the supports 44, 45 and are adequately supported. Additional restraint rods 50 can be added if desired. In addition, to facilitate stowing the ramp sections 48, the supports 44, 45 and preferably have upwardly standing members or rods 52, shown here as extending upwardly from opposite ends of the beams 46, 47 to prevent the ramp sections 48 from sliding off the beams 46, 47 when in there stowed position.

The rear support 45 is preferably constructed to facilitate stowing the rear plow 24 when not in use and to facilitate transporting the apparatus 10. Preferably, a receptacle 54 is attached, such as through a weld joint for example, to the rear support 45, wherein the receptacle 54 is preferably inclined downwardly from the support 45 and sized for receipt of a tongue 55 pivotally carried by the rear plow 24.

Figure 4:
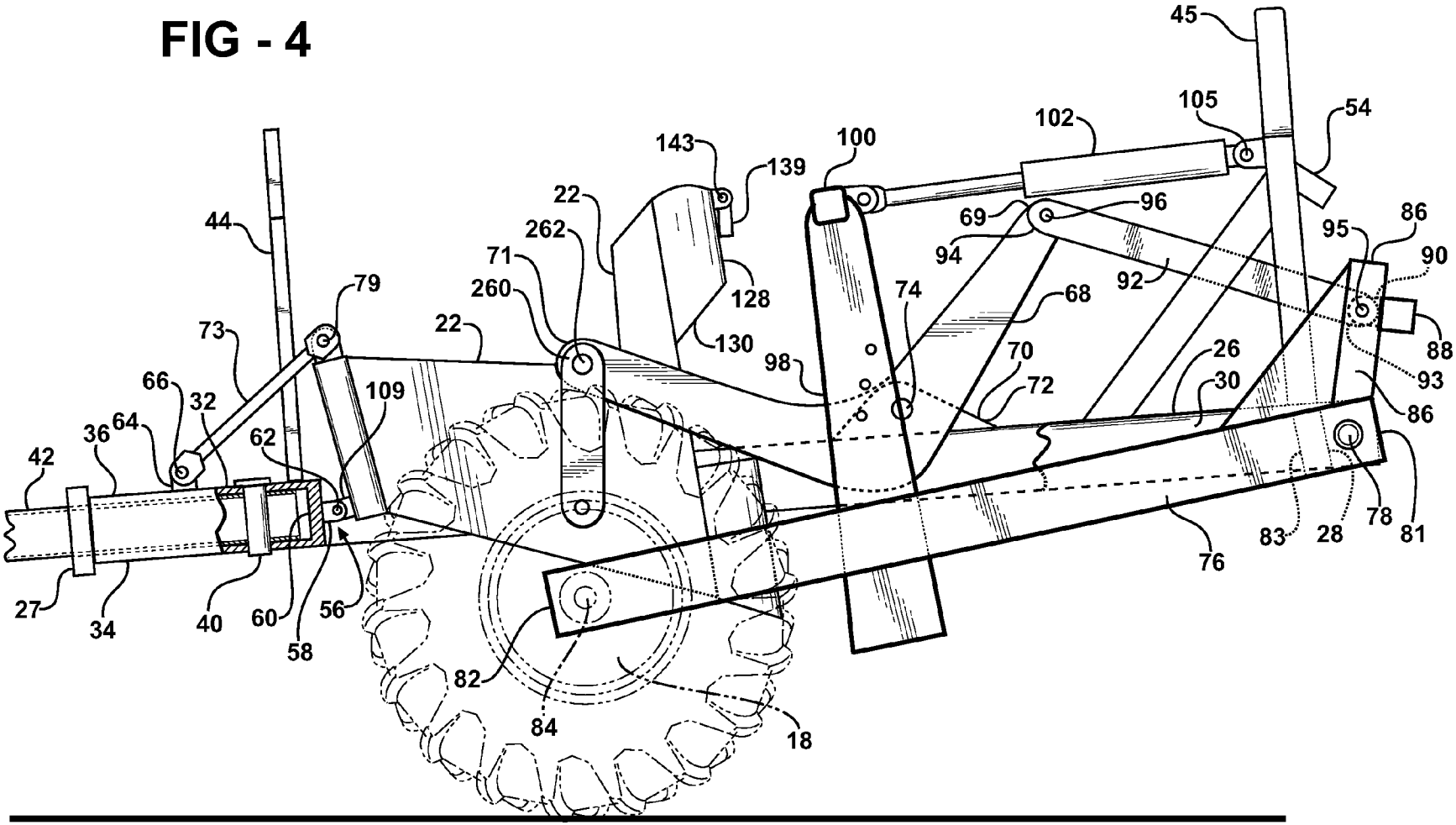
FIG. 4 is an enlarged side elevational view with parts broken away and the pipe extractor in a transport position.
Figure 5:
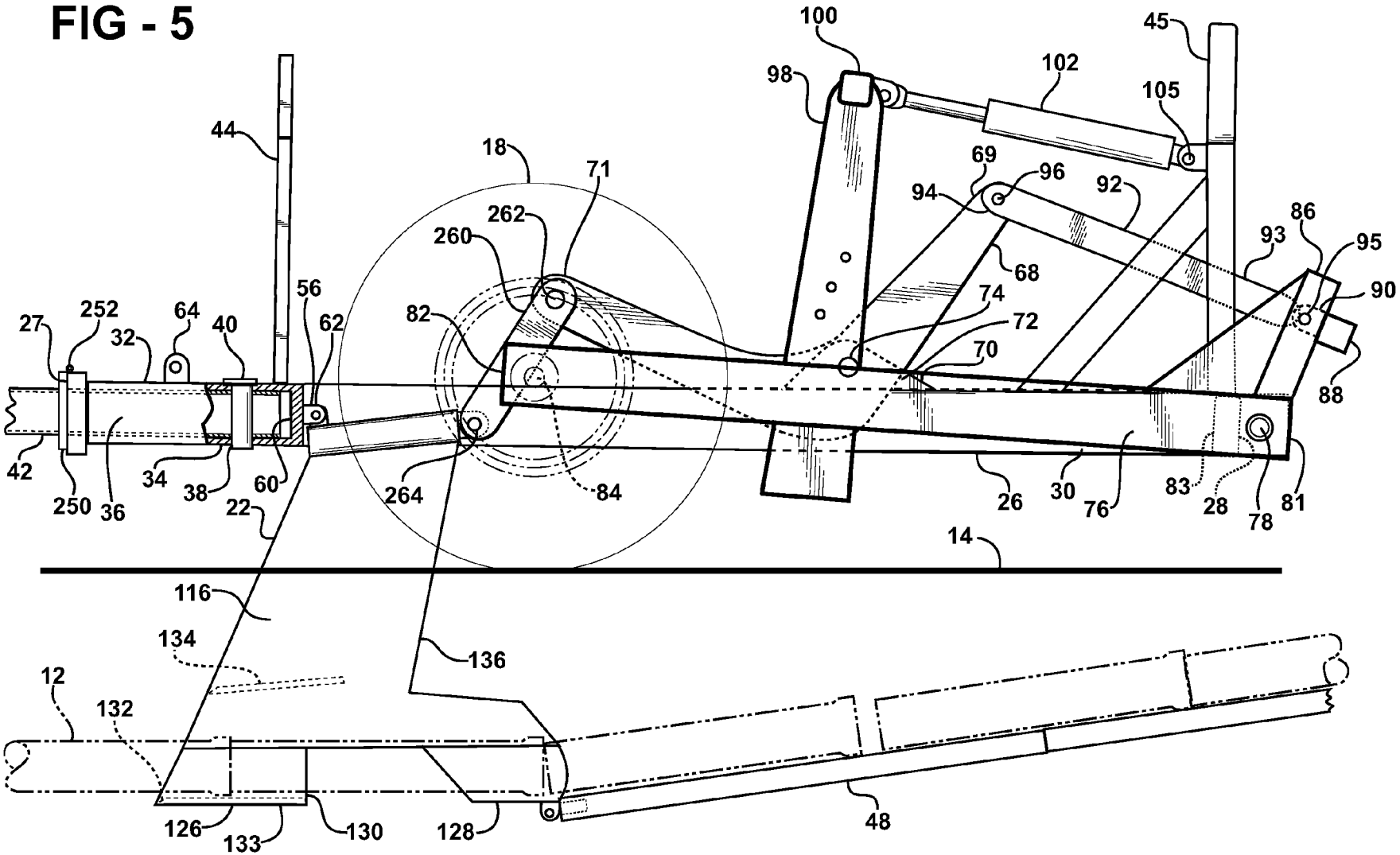
FIG. 5 is an enlarged side elvational view with parts broken away and the pipe extractor in operation.
Figure 7:
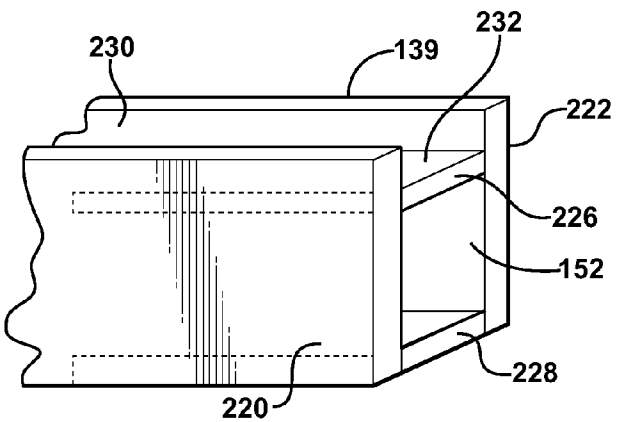
FIG. 7 is an enlarged perspective view of an end of a ramp section with a receiver passage that receives the tongue of a second ramp section.

The main frame 26 has a pair of extractor housings 56 defined at least in part by the sides 29, 30 of the frame 26 and a pair of flanges 58 spaced laterally inwardly from the sides 29, 30. The flanges 58 are preferably attached, such as through the use of a weld joint, to a support beam 60 extending laterally between the sides 29, 30 as shown in FIGS. 4 and 5. Each flange 58 has a through opening aligned with an opening in the respective sides 29, 30, wherein the aligned openings are sized for receipt of a pivot pin 62. To facilitate maintaining the extractor 22 in its stowed position, shown in FIGS. 1, 2 and 4, the main frame 26 preferably has a pair of laterally spaced uprights 64 arranged for releasable attachment to the extractor 22. The uprights 64 preferably have through openings for receipt of lock pivot pins 66 to releasably maintain the extractor 22 in its upright stowed position. The lock pins 66 attach the forward ends of tension links 73 and 77 to the uprights 64. The rear ends of the tension links are attached to the extractor 22, as shown in FIG. 2, by pivot pins 79.

Figure 2:
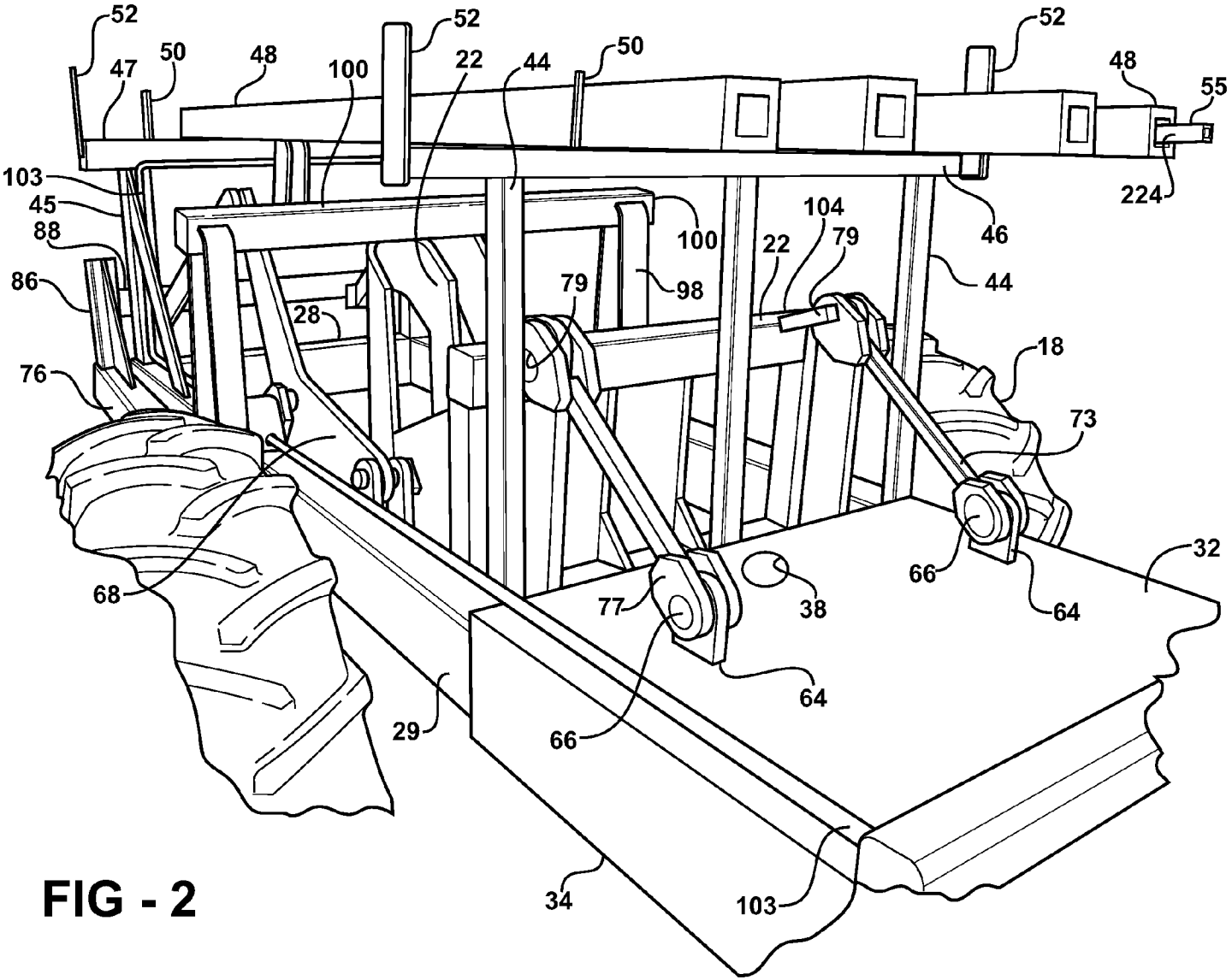
FIG. 2 is an enlarged perspective view of the pipe extractor with parts broken away.

The main frame 26 preferably provides pivotal attachment of a pair of driven links 68 (FIGS. 2, 3 and 4). A pair of brackets or housings 70 are preferably welded opposite one another to the sides 29, 30 of the frame 26. The housings 70 each have a pair of laterally spaced flanges 72 having axially aligned through holes. The through holes are sized for receipt of lock pins 74, wherein the pivot pins extend through openings located generally between opposite ends 69, 71 of the driven links 68 to provide pivotal support of the driven links 68 relative to the main frame 26.

As best shown in FIGS. 3, 4 and 5, the wheels 18 are supported for pivotal movement between raised and lower positions relative to the main frame 26 by a pair of arms 76. The arms 76 are journaled on a transverse beam 83 for pivotal movement relative to the main frame 26 via an axle 78. The axle 78 is journaled within laterally spaced and axially aligned bearing housings attached to the rear transverse beam 83, on the rear end 28 of the main frame 26, for pivotal movement about a transverse horizontal axis of the axle 78. The axle 78 is fixed at opposite ends adjacent an end 81 of each arm 76, such as through a weld joint. It should be recognized that the axle 78 may be otherwise attached to the arms 76, such as through the use of threaded fasteners, friction fit or pins, for example and without limitation, or that the axle 78 may be supported to rotate relative to the arms 76.

Each arm 76 has another end 82 with a stub shaft or hub support 84 extending laterally outwardly therefrom and being sized for journaled support of the wheels 18 to allow the wheels 18 to rotate freely about the supports 84. Preferably, the hub supports 84 are arranged so that transporting road tires can be readily interchanged with generally larger off-road tires. As such, the hub supports 84 are preferably laterally spaced so that the road tires conform to government road tire track width regulations. It should be recognized that the road tires are used for transporting the apparatus 10 at increased road or highway speeds, whereas the off-road tires are preferably used while extracting the pipe 12.

Each of the arms 76 have upstanding stubs 86, shown in FIGS. 4 and 5, welded adjacent the ends 81. A cross beam 88 extending laterally between the upstanding stubs 86 and is welded to the stubs. The cross beam 88 has laterally spaced flanges 90 extending toward the driven links 68 for operable attachment of the cross beam 88 to the driven links 68. Preferably, each flange 90 is pivotally attached to one of a pair of drive links 92 at one end 93 of each drive link 92 by a pivot pin 95, while another end 94 of each drive link is pivotally attached to a separate one of the ends 69 of the corresponding driven link 68. As described in the previous pivotal connections, lock pins 96 are preferably used to facilitate the pivotal connections.

Each arm 76 has an upstanding lever arm 98 extending generally perpendicularly to the respective arm 76. The lever arms 98 are shown here as being joined together by a laterally extending connector 100 to insure that the arms 76 pivot in unison relative to the main frame 26. A pair of double acting actuators, represented here by way of example and without limitation as hydraulic cylinders 102 actuatable via hydraulic fluid channeled through hydraulic lines shown generally at 103, in FIGS. 1 and 2. The hydraulic cylinders 102 extend between the rear supports 45 of the main frame 26 and the lever arms 98. The cylinder end of each cylinder 102 is connected to the upstanding support 45 by pins 105. The rod end of each hydraulic cylinder 102 is connected to the upstanding lever arms 98 through the connector 100 by pins 101. It should be recognized that the hydraulic lines 103 are preferably arranged for quick connect/disconnect to hydraulic lines on a towing vehicle, or that the actuators may be otherwise actuatable, such as by being electrically powered for movement. The actuators 102 move between a retracted position and an extended position to raise the arms 98 and lower the arms, relative to the main frame 26. The hydraulic cylinders 102 are preferably double acting. Double acting cylinders 102 can lift the wheels 18 off the ground thereby loading the pipe extract or 22 for better penetration into the soil if needed. As the arms 98 are raised, so too are the wheels 18, thereby lowering the extractor 22 relative to the ground surface 14. As the arms 98 are lowered, so too are the wheels 18, thereby raising the extractor 22 relative to the ground surface 14.

Figure 1:
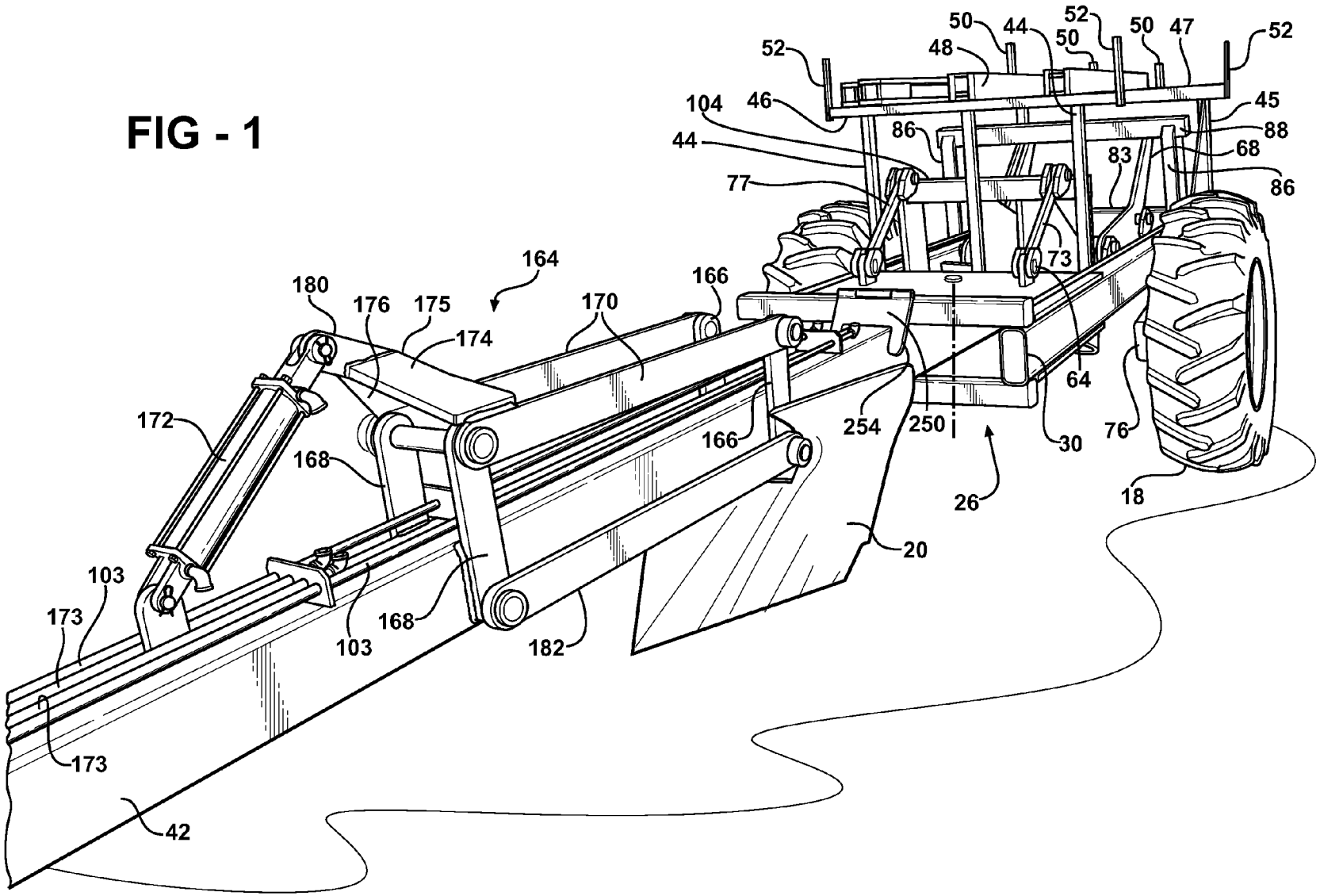
FIG. 1 is a perspective view of the pipe extractor apparatus with parts broken away.
Figure 6:
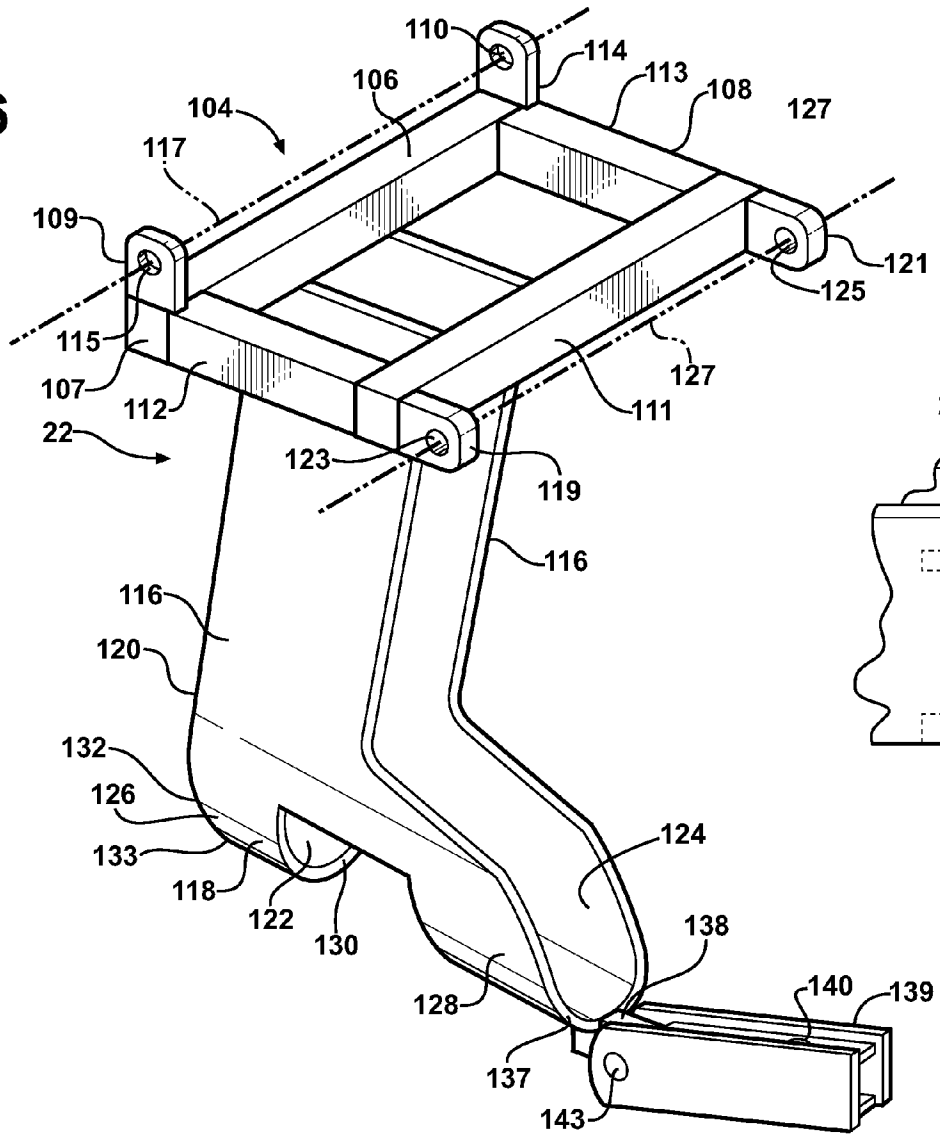
FIG. 6 is an enlarged perspective view of the pipe extractor tool shown removed from the frame.

The extractor 22, as shown in FIG. 6, has an extractor frame 104. The extractor frame 104 includes a front beam 106 that is transverse to the main frame 26 and a rear beam 111 that is spaced from and parallel to the front beam. A left fore and aft beam 112 is fixed to the front beam 106 and the rear beam 111 of the extractor frame. A right fore and aft beam 113 is parallel to the left fore and aft beam 112 and is fixed to the front beam 106 and the rear beam 111. A left ear 109 is fixed to the left end of the front beam 106. A right ear 114 is fixed to the right end of the front beam 106. A bore 115 through the left ear 109 and a bore 110 through the right ear 114 are coaxial with each other and define an extractor front pivot axis 117. A left tongue 119 is fixed to the left end of the rear beam 111. A right tongue 121 is fixed to the right end of the rear beam 111. A bore 123 through the left tongue 119 and a bore 125 through the right tongue 121 are coaxial with each other and an extractor rear pivot axis 127. The left ear 109 and the right ear 114 are pivotally connected to the main frame 26 and the extractor housing 56 by pivot pins 62. The left tongue 119 of the extractor frame 104 is connected to the rear end of the tension link 73 by pivot pin 79 and the right tongue 121 of the extractor frame 104 is connected to the rear end of the tension link 77 by a second pivot pin 79, to hold the pipe extractor 22 in a transport position as shown in FIGS. 1, 2 and 4.

The extractor 22 has a pair of laterally spaced shanks or walls 116 depending from another side of the frame 104. The shanks 116 extend generally perpendicularly from the extractor frame 104 to a generally U-shaped lower wall, referred to hereafter as a shoe 118. To facilitate movement of the shoe 118 through the earth as it is extracting the pipe 12, the walls 116 preferably have tapered leading or cutting edges 120 that are preferably tapered between 15-60 degrees, and more preferably between 30-45 degrees. The tapered edges 120, aside from assisting in the cutting movement of the extractor 22 through the earth, also assist in compacting the earth laterally outwardly to facilitate extracting the pipe 12. The shoe 118 has an inner surface 122 defining a through passage 124 that can be sized to extract any diameter pipe, as desired. Generally, the pipes range from 4-16 inches in diameter, though it should be recognized that the shoe 118 can be sized to extract smaller or larger pipes, if desired.

The shoe 118 is represented here as having a forward section 126 and a rearward section 128, with an opening 130 being defined therebetween. To further facilitate movement of the shoe 118 through the earth, the forward section 126 preferably has a tapered leading edge 132 extending upwardly between about 15-60 degrees from a bottom surface 133 rearwardly toward the inner surface 122. In addition to assisting in the movement through the earth, the tapered leading edge 132 also prevents the pipe 12 from being damaged, such as by being cut or gouged as it is being extracted. The opening 130 prevents the build-up of debris, such as dirt or clay, for example, from occurring between the pipe 12 and the inner surface 122 of the shoe 118 by allowing the debris to pass through the opening 130. The extractor 22 preferably has a deflector plate 134 extending laterally between the shanks 116 that is spaced a predetermined distance from the inner surface 122 of the shoe 118. The plate 134 is preferably inclined upwardly toward a trailing edge 136 of the shanks 116 to assist in directing the pipe 12 in the intended direction as it is being extracted, and to restrict the pipe 12 from moving upwardly within the extractor 22. The deflector plate 134 also loosens soil above the pipe 12 to facilitate lifting the pipe through the soil.

The rearward section 128 of the shoe 118 has a tongue 138 fixed to its trailing edge 137. A ramp section connector 139 is pivotally connected to the tongue 138 by a pivot pin 143. The tongue 55 on a ramp section 48 is received in a passage 152 in the ramp section connector, so that the ramp sections 48 are pulled by the extractor 22 while extracting the pipe 12. To maintain the connection between the tongue 138 and the respective ramp section 48, a pin 140 is preferably used to releasably lock the tongue 55 on a ramp section 48 to the connector 139.

Each ramp section 48 of the ramp assembly 141 includes a left side elongated steel bar 220 and a right side steel bar 222. These steel bars 220 and 222 are parallel to each other and laterally spaced apart to provide a vertical slot 230 between them. A steel bar 224 is positioned between the two elongated bars 220 and 222 on one end and welded to both elongated steel bars. A portion of the steel bar 224 extends from the end of the elongated bars 220 and 222 to form a tongue 55. An upper steel plate 226 and a lower steel plate 228 are placed in the slot 230 on the opposite end from the bar 224 that forms the tongue 55 and welded in place. The upper plate 226 is recessed downward in the slot 230 to form a trough 232. The passage 152 is the proper size to receive the tongue 55 formed by the exposed end of the steel bar 224 and form a substantially rigid connection between two ramp sections 48. The ramp section connector 139 is the same construction as an end of a ramp section 48 with the passage 152 except for the connection to the tongue 138 by the pivot 143. Soil and sand are free to pass through the vertical slot 230 except for the short connector section between the ramp sections 48. The pins 140 that lock two ramp sections 48 are subjected to shear forces and isolated from bending loads. The upper edges of the elongated steel bars 220 and 222 define a channel that tends to guide a pipe 12 as the pipe is lifted from the ground. The last ramp section 48 in the assembly 141 is arranged for attachment to the rear plow 24 so that the rear plow is pulled by the extractor 22 via the ramp assembly 141. A connector member 240 is pivotally attached to the plow 24 by a pivot pin 242. A tongue 55 on the connector member 240 is received in the passage 152 of the last ramp section 48 and locked in place by a pin 140. It should be recognized that the ramp sections 48 can be constructed from solid sections of material, and can be extruded, or otherwise constructed, if desired.

The rear plow 24 has a pair of blades 150 converging toward one another from front to back to plow the dirt or spoils plowed by the front plow 20 back into the trench 21 as the rear plow 24 is pulled by the ramp assembly 141. The blades 150 are preferably attached adjacent their bottom edges 152 to a pair of laterally spaced skids 154, and at their upper edges 156 to a support beam 158, such as through weld joints. The skids 154 are arranged generally parallel to one another and have bottom surfaces 160 adapted for sliding movement over the ground surface 14. The skids 154, aside from being attached to the blades 150, are also attached to the support beam 158 via a pair of inclined braces 162. As shown in a connector member 240 with a tongue 55 is pivotally attached to the support beam 158 to facilitate attachment of the rear plow 24 to the ramp assembly 141. The rear plow 24 is shown in its operating position in FIG. 5.

The front plow 20 is preferably carried for vertical movement relative to the hitch beam 42 as shown in FIGS. 1 and 3. The front plow 20 is carried by the hitch beam 42 via a panographic linkage assembly 164. The linkage assembly 164 includes a four bar link arrangement on each side of the hitch beam 42. The front plow 20 is fixedly attached, such as through a weld joint, for example, to a pair of driven links 166 for conjoint movement with a pair of support links 168 and two pairs of drive links 170 and 182 in response to movement of an actuator, such as a hydraulic cylinder 172, for example. The actuator 172 is operably attached to the drive links 170 via a generally V-shaped bracket 174 and is moveable between retracted and extended positions to move the front plow 20 between a raised, non-plowing position and a lowered, plowing position, respectively. The actuator 172 is a double acting hydraulic cylinder connected to a tractor hydraulic system by hydraulic lines 173. The bracket 174 has a pair of legs that diverge to ends that are laterally spaced for fixed attachment to the drive links 170, such as through a weld joint. The legs converge to an apex 180 for pivotal pin attachment to an end of the actuator 172. To hold the links 166 in a vertical position a pair of fourth links 182 are pivotally attached to the support and driven links 168, 166. The drive links 170 are parallel to the forth links 182.

The hitch beam 42 has rear end connection to the main frame 26 by a hitch pin 40. The front end to the hitch beam is adapted to be pivotally connected to a tractor 16, such as through a universally pivotal tongue 266. The housing 36 defined between the upper and lower plates 32, 34 allows the hitch beam 42 to pivot generally laterally in a pendulum fashion, thereby allowing the mainframe 26 to pivot relative to the hitch beam 42. This pivotal movement about the hitch pin 40 permits the main frame 26 and thus, the extractor 22 to automatically follow the pipe 12 beneath the ground surface 14. A forked plate 250 is pivotally attached to the front of the main frame 26 for pivotal movement about a transverse horizontal axis. In the position shown in FIGS. 1 and 5, the plate 250 keeps the hitch beam 42 from pivoting about the hitch pin 40 making it possible to tow the pipe extractor to a site for extracting pipe 12 from the ground. Once the pipe extractor 10 is in position to extract pipe, the forked plate 250 is pivoted about a hinge pin 252 from the position shown in FIG. 5 to the position shown in FIG. 3. With the forked plate 250 in the position shown in FIG. 3, the main frame 26 is free to pivot about the hitch pin 40 and the extractor 22 can follow the pipe 12 that is to be extracted.

To prepare the extractor 22 to extract pipe 12, the pins 79 are removed from the tension links 73 and 77 to permit the extractor frame 104 to pivot about the frame front pivot axis 117. Pivotal movement of the extractor frame 104 moves the extractor 22 from a generally horizontal transport and storage position shown in FIGS. 2 and 4 to a generally vertical working position shown in FIGS. 3 and 5. The forward end 71 of the driven link 68 on the left side of the main frame 26 is pivotally connected to a left connector link 260 by a pivot pin 262. A second end of the left connector link 260 is pivotally connected to the left tongue 119 on the extractor frame 104 by a pivot pin 264. The forward end 71 of the driven link 68 on the right side of the main frame is pivotally connected to a right connector link 260 by a pivot pin 262. A second end of the right connector link 260 is pivotally connected to the right tongue 121 on the extractor frame 104 by a pivot pin 264.

The drive links 92, the driven links 68 and the connector links 260 pivot the extractor frame 104 about the extractor front pivot axis 117 to control the attitude of the U-shaped lower wall 118 of the extractor 22 relative to the direction of forward movement of the extractor. The U-shaped lower wall of the shoe 118 of the extractor 22 is positioned with forward section 126 slightly below the rear extractor section 128 so that movement of the U-shaped lower wall forward in soil exerts a downward force on the U-shaped lower wall of the extractor. Pipe 12 that is to be extracted is not a uniform distance below the ground surface 14. Generally the ground surface 14 is not as horizontal as the pipe 12 that is to be removed and causes the variable depth. It is therefore necessary to raise and lower the extractor 22 as the depth of the pipe 12 changes. The hitch height of a tractor pulling the pipe extractor 10 is not changed when the depth of pipe changes. The angle of the extractor shoe 118 changes each time the hydraulic cylinders 102 are extended or retracted to raise or lower the extractor 22. The drive links 92, which are connected to the arms 76 and wheels 18, transmit motion through the driven links 68 and the connector links 260 to the extractor frame 104 to maintain the U-shaped shoe 118 in the desired position relative to the direction of forward movement of the extractor 22 during removal of pipe 12.

The pipe 12 that requires removal often has welded joints making the pipe one continuous piece with a uniform outside diameter as shown in FIG. 3. However, pipe 12 with joints, as shown in FIG. 5, can also be removed.

The front plow 20 as shown in the drawing is a lister with a double moldboard that turns up the soil on each side of the furrow that is formed. Depending upon the soil and surface conditions, it may be desirable to employ a modified front plow 20. A disk coulter could be added to cut through plant material under the ground as well as on the surface for example. It may also be desirable to employ subsoiler shank in place of the lister unit described above.

The depth of the U-shaped shoe 118 is controlled using a hydraulic system on the towing tractor to control the flow of hydraulic fluid to and from the hydraulic cylinders 102. Ideally the extractor 22 will make minimal contact with the pipe 12 that is being extracted. If the extractor shoe is too high or too low, contact with the pipe 12 will increase the power required from the tractor to pull the extractor apparatus 10. This increased power requirement is difficult to detect when the extractor 22 is only a little too high or a little too low. Even when there is a substantial increase in the load on the towing tractor, the operator can not determine if the increase towing force is due to the U-shaped shoe 118 being too low or too high. The load on the tires and wheels 18 is an indication of the vertical forces exerted on the extractor 22 by the pipe 12. If the pipe 12 is exerting a downward force on the U-shaped shoe 118, the tires and wheels 18 will resist the downward load and the hydraulic fluid pressure in the head end of the hydraulic cylinders 102 increases. If the pipe 12 is exerting little or no downward force on the U-shaped shoe 118, the tires and wheels 18 will be lightly loaded and the hydraulic fluid pressure in the head end of the hydraulic cylinders 102 decreases. The hydraulic pressure in the head end of the hydraulic cylinders 102 can be monitored by a pressure gauge connected to the line 103 that is connected to the head end of the cylinders. The pressure gauge permits the operator to hold the U-shaped shoe 118 up close to the pipe 12 but not exerting a significant lifting force on the pipe. The ramp assembly 141 will exert a lifting force on the pipe 12. The force on the extractor 22 tends to be relatively constant and will not therefore prevent the employment of hydraulic pressure changes in the head ends of cylinders 102 to indicate the need to raise or lower the extractor 22.

The extractor 22 as described above and shown in drawing FIG. 6 has two shanks 116. The two shanks 116 provide strength and lateral stiffness. An extractor 22 can be made with a single shank and a shoe 118 that is secured to the shank. A plurality of replaceable shoes 118 for different diameter pipes 12 can be employed. The single shank 116 makes it somewhat easier to change shoes 118 to fit the pipe that is to be extracted. The shoe 118 steers and guides the main frame 26 by pivoting the extractor 22 about the vertical axis of the hitch pin 40 if the through passage 124 of the shoe 118 is only slightly larger in diameter than the diameter of the pipe 12 that is being extracted.

During use of the extractor 10, a section of the pipe 12, is exposed through the use of a backhoe, for example, and upon removal of a short piece of the pipe 12, the extractor 22 is lowered into position by actuating the cylinders 102 extending between the supports 45 and the lever arms 98. As the cylinders 102 retract, the arms 76 pivot upwardly toward the main frame 26, thereby causing the tires 18 to rise relative to the main frame 26. As a result, the extractor 22 is lowered so that the pipe 12 is generally aligned for movement through the through passage 124 of the shoe 118. As the shoe 118 is lowered into position, a link assembly, including the drive links 92 and driven links 68 and connector links 260, causes the extractor shoe 118 to remain generally horizontal relative to the ground surface 14 and the pipe 12 throughout the movement of the cylinders 102 between their extended and retracted positions. The forked plate 250 is pivoted to a position in which the hitch beam 42 is disengaged as shown in FIG. 3. The extractor 22 is allowed to pivot about the extractor front pivot axis 117 relative to the main frame 26. Accordingly, the through passage 124 of the shoe 118 remains substantially parallel to the pipe 12 as the extractor 22 is raised and lowered as explained above. The drive links 92, the driven links 68 and the connector links 260 form a self leveling linkage system.

The individual ramp sections 48 are attached to one another, with the leading section being attached to the tongue 138 of the extractor 22, and the trailing section being attached to the tongue 55 of the rear plow 24. As such, the rear plow is pulled in use by the ramp assembly 141, which in turn is pulled by the extractor 22.

The front plow 20 is lowered to its furrow plowing position by actuating the cylinder 172 to move toward its extended position. The depth of the trench 21 created is controlled by limiting the movement of the cylinder 172. As the cylinder 172 is extended, the front plow 20 is lowered. Desirably, the front plow 20 may be lowered to a depth of about one foot beneath the ground surface 14. The lister front plow 20 can be replaced by a subsoil shank to loosen soil to a greater depth, if required. Upon reaching the desired depth with the front plow 20, the apparatus 10 is generally ready to begin extracting the pipe 12 in a continuous extraction process.

As the pipe 12 is being extracted, generally at a rate of about 1 mile per hour or more, the pipe 12 passes through the through passage 124 of the extractor 22, upwardly along the ramp assembly 141 and preferably over the rear plow 24, then back to the ground surface 14. As the pipe 12 is traveling over the rear plow 24, the rear plow is backfilling the trench 21 created by the front plow 20 and the extractor 22. The extractor 22 is able to automatically follow the pipe 12 as the pipe makes turns beneath the ground surface 14. This results from the main frame 26 being in pivotal connection with the hitch beam 42. Preferably, to facilitate the pivotal movement of the main frame relative to the hitch beam 42, the leading edge 132 of the shoe 118 extends forwardly, such as about one foot for example, of the pivot point provided by the hitch pin 40. Accordingly, the hitch beam 42 pivots within the housing 36 to allow the shoe 118 to follow the pipe 12. If the main frame 26 initiates a turn to follow the pipe 12, the user may readily turn the tractor to follow the path of the pipe 12. If the user desires the hitch beam 42 to remain in a non-pivotal relation to the main frame 26, a forked plate 250 pivotally attached to the main frame 26, may be lowered to capture the hitch beam 42 in a generally aligned orientation relative to the main frame 26 as shown in FIG. 1. The forked plate 250 preferably has a pair of arms 254 that extend outwardly to fit closely against opposite sides of the hitch beam 42. The plate 250 is easily moved into and out of locking engagement with the hitch beam 42 by simply lifting or lowering the lock for pivotal movement relative to the main frame 26.

It should be recognized that upon reading the disclosure herein, one ordinarily skilled in the art of the above subject matter would readily recognize other embodiments than those disclosed herein, with those embodiments being within the scope of the claims that follow.

We claim:

1. A pipe extractor for extracting pipe from the ground comprising:

a main frame;

a pair of support wheels journaled on a pair of arms pivotally attached to the main frame and including at least one liner actuator connected to the main frame and to the pair of arms and operable to raise and lower the main frame;

an extractor assembly including an extractor frame pivotally attached to the main frame for pivotal movement about a transverse horizontal extractor pivot axis, at least one shank attached to the extractor frame, an extractor shoe connected to a lower end of the at least one shank and wherein the extractor shoe includes a lower wall that defines a through passage which pipe to be extracted passes through;

a ramp assembly pivotally attached to the extractor shoe an extending rearwardly and upwardly from a trailing edge of the extractor shoe and having an upwardly facing pipe guide surface that guides pipe passing through said through passage upto the ground surface;

a hitch beam, for towing the main frame, having a rear end pivotally attached to the main frame by a hitch pin for pivotal movement about a generally vertical axis and a hitch assembly mounted on a front end of the hitch beam;

a self leveling linkage assembly attached to the pair of arms pivotally attached to the main frame, attached to the main frame, and attached to the extractor frame for controlling pivotal movement of the extractor frame relative to the main frame; and wherein the through passage through the extractor shoe cooperates with pipe being extracted to pivot the main frame about the hitch pin and relative to the hitch beam.

2. A pipe extractor, as set forth in claim 1 including a front earth working tool attached to the hitch beam forward of the main frame and movable vertically by a hitch mounted hydraulic cylinder between a raised non-use position and a lowered earth/working position.

3. A pipe extractor, as set forth in claim 2, wherein the earth working tool is a lister.

4. A pipe extractor as set forth in claim 1 including a lock member movable between a released position in which the main frame is free to pivot about the hitch pin relative to the hitch beam and an engaged position in which the main frame is blocked from movement relative to the hitch beam.

5. A pipe extractor, as set forth in claim 1, wherein the extractor assembly includes a second shank attached to the extractor frame and wherein the second shank is spaced from the at least one shank and generally parallel to the at least one shank; and wherein the extractor shoe includes a U-shaped lower wall a shoe left side integral with the at least one shank and a shoe right side integral with the second shank.

6. A pipe extractor, as set forth in claim 1, wherein the self leveling linkage assembly includes a drive link pivotally attached to the pair of arms pivotally attached to the main frame and to a driven link, a pivot pin pivotally connecting the driven link to the main frame, and a connector link pivotally connected to the driven link and to the extractor frame and wherein the self leveling linkage is operable to pivot the extractor frame relative to the main frame in response to movement of the pair of support wheels to adjust the elevation of the main frame.

7. A pipe extractor, as set forth in claim 1, including a rear plow attached to the ramp assembly and wherein the rear plow moves soil laterally toward the trench pipe was removed from.

8. A pipe extractor, as set forth in claim 1 wherein the ramp assembly includes a plurality of ramp sections connected together by a male extension and a female receptacle that form a ramp section connector that is substantially rigid.

9. A pipe extractor, for extracting pipe from the ground, comprising:

a main frame with a left side beam and a right side beam parallel to and laterally spaced from each other, a transverse beam fixed to the left side beam and the right side beam adjacent to a rear end of the main frame;

a left wheel arm with a left arm rear portion, a right wheel arm with a right arm rear portion, an axle attached to the left arm rear portion and the right arm rear portion and pivotally supporting the left wheel arm outboard of the main frame left side beam, and pivotally supporting the right wheel arm outboard of the main frame right side beam, a left tire and wheel journaled on a forward end of the left wheel arm, a right tire and wheel journaled on a forward end of the right wheel arm, and a cross beam fixed to the left wheel arm and the right wheel arm and spaced from the axle;

at least one hydraulic cylinder connected to the main frame and to the left wheel arm and to the right wheel arm and operable to move the main frame vertically;

an extractor assembly including an extractor frame pivotally attached to the main frame for pivotal movement about an extractor pivot axis, a pair of spaced apart shanks with upper shank ends attached to the extractor frame, and an extractor shoe with a U-shaped lower wall having a shoe left edge integral with a lower end of one of the pair of spaced apart shanks and a shoe right edge integral with a lower end of the other one of the pair of spaced apart shanks and wherein the pair of shanks and the extractor shoe provide a through pipe passage;

a ramp assembly pivotally attached to the extractor shoe and extending rearwardly and upwardly from a trailing edge of the extractor shoe and including a pair of elongated spaced apart ramp bars that lift pipe passing through the pipe passage upwardly out of the ground;

at least one self leveling linkage assembly including a drive link pivotally attached to the left wheel arm and the right wheel arm, a driven link pivotally attached to the main frame and having a driven link rear end pivotally attached to the drive link, and a connector link pivotally attached to a driven link front end and pivotally attached to the extractor frame and operable to pivot the extractor frame about the extractor pivot axis in response to pivotal movement of the left wheel arm and the right wheel arm relative to the main frame;

a hitch beam, for towing the main frame, having a rear end pivotally attached to the main frame by a hitch pin for pivotal movement about a generally vertical axis and a hitch assembly mounted on a front hitch beam end;

a lock member mounted on the main frame and movable between a released position in which the main frame is free to pivot about the hitch pin relative to the hitch beam and an engaged position in which the main frame is blocked from pivotal movement relative to the hitch beam; and wherein the extractor shoe cooperates with pipe being extracted to pivot the main frame about the hitch pin relative to the hitch beam when the lock member is in a released position.

10. A pipe extractor, as set forth in claim 9 including a front earth working tool attached to the hitch beam forward of the main frame and movable vertically by a hitch mounted hydraulic cylinder between a raised non-use position and a lowered earth/working position.

11. A pipe extractor, as set forth in claim 10 wherein the earth working tool is a lister.

12. A pipe extractor, as set forth in claim 9, including a deflector plate secured between the pair of space apart shanks above the through pipe passage that extends rearwardly and upwardly from a horizontal leading edge and that lifts soil upward as the soil passes between the spaced apart shanks.

* * * * *